United States Patent [19]

Levine

[11] 4,240,760

[45] Dec. 23, 1980

[54] FOAM SCRUBBING DEVICE INCORPORATING A CLEANSER

[75] Inventor: Stella R. Levine, Chappaqua, N.Y.

[73] Assignee: Brewster Laboratories, Inc., New York, N.Y.

[21] Appl. No.: 927,251

[22] Filed: Jul. 21, 1978

[51] Int. Cl.[3] ..... A47K 7/02

[52] U.S. Cl. ..... 401/201; 252/117

[58] Field of Search ..... 401/6, 196, 201; 252/134, 117, 92, 93, DIG. 16; 15/244 R, 244 A, 244 B, 244 C, 122

[56] References Cited

U.S. PATENT DOCUMENTS

| | | | |
|---|---|---|---|
| 2,054,198 | 9/1936 | Jones | 401/201 |
| 2,070,313 | 2/1937 | Pieper | 401/201 |
| 2,083,871 | 6/1937 | Serewicz | 15/122 |
| 2,107,036 | 2/1938 | Kingman | 15/122 |
| 2,697,847 | 12/1954 | Levinson et al. | 15/122 |
| 2,829,392 | 4/1958 | Dupuy | 15/122 |
| 2,899,780 | 8/1959 | Bottino | 51/185 |
| 3,066,347 | 12/1962 | Vosbikian et al. | 15/568 |
| 3,067,450 | 12/1962 | Mirth | 401/201 |
| 3,114,928 | 12/1963 | Spiteri | 15/568 |
| 3,175,331 | 3/1965 | Klein | 51/400 |
| 3,428,405 | 2/1969 | Posner | 401/201 |
| 3,581,447 | 6/1971 | Falivene | 401/201 X |
| 3,860,349 | 1/1975 | Scott | 401/8 |
| 3,870,419 | 3/1975 | Sage | 401/8 |
| 3,903,008 | 9/1975 | Deweever et al. | 252/134 X |
| 3,926,828 | 12/1975 | O'Neill et al. | 252/117 |

OTHER PUBLICATIONS

Lesser, "Transparent Soaps", *Soap and Sanitary Chemicals,* Apr., 1950, pp. 41–42, 98, 145 and 147.

*Primary Examiner*—Edward M. Coven

*Attorney, Agent, or Firm*—Blum, Kaplan, Friedman, Silberman & Beran

[57] ABSTRACT

A foam scrubbing device incorporating a cleanser formed from two layers of foam material having different characteristics heat sealed along their respective peripheries is provided. The two layers of foam material have different cell coarseness to provide varying degrees of abrasiveness, permeability and flexibility. The device is formed with the different layers of foam material having different thicknesses to permit substantially equal amounts of cleanser to pass through each layer.

6 Claims, 5 Drawing Figures

FIG. 1
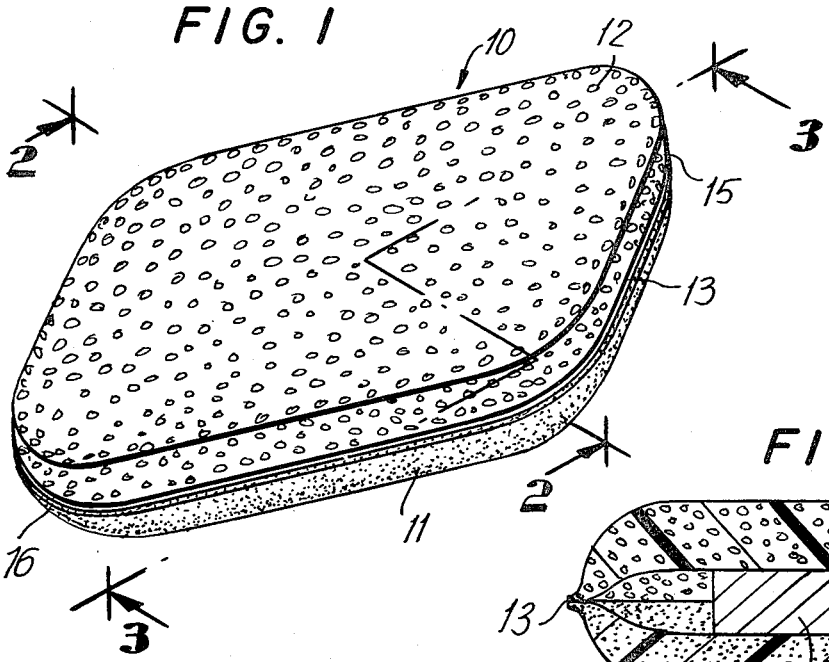
FIG. 2
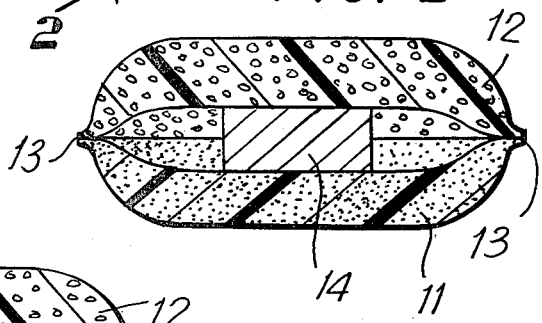
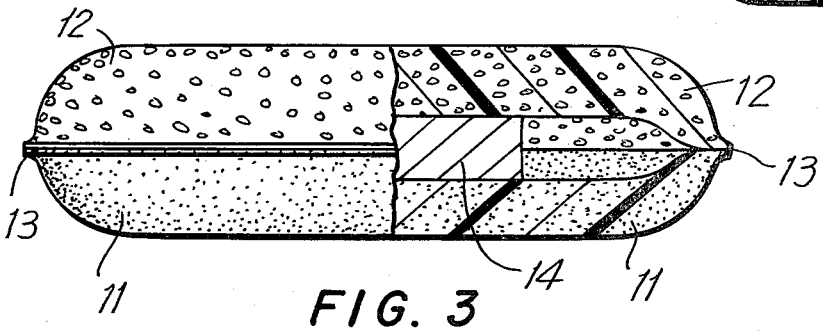
FIG. 3
FIG. 4
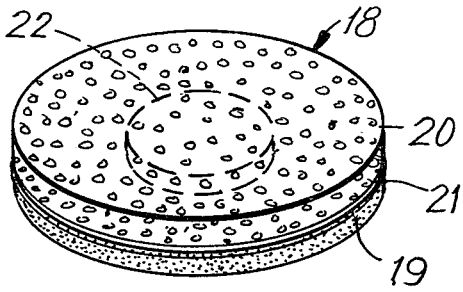
FIG. 5
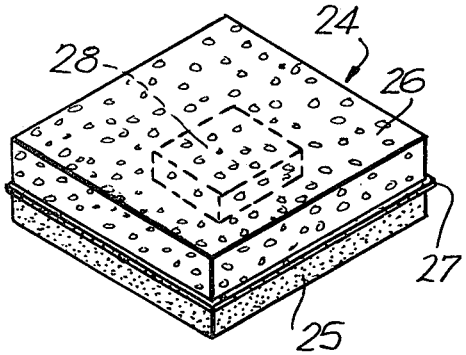

FOAM SCRUBBING DEVICE INCORPORATING A CLEANSER

BACKGROUND OF THE INVENTION

This invention relates generally to an improved foam scrubbing device, and in particular to an improved foam scrubbing device having a cleanser therein.

Spongy materials, such as cotton wash cloths and towels have been used to remove dirt and dead tissue from the skin, cleanse oily skin, loosen comedones, blackheads and relieve follicular plugging and prevent formation of new ones. However, the use of such materials has been less than fully satisfactory. For example, a cleansing agent must be added for application to the skin. This often results in an uneven distribution of cleanser and often requires contacting the used material to the cleanser for reapplication. In addition, a soft spongy material is less than fully satisfactory for deep cleansing. Moreover, the non-defined shape of a cotton washcloth makes it difficult to perform an effective cleansing job in a neat and orderly manner. A washcloth is often used for other purposes thereby rendering it ineffective for deep cleansing. Accordingly, it is desirable to provide an improved cleansing device which permits uniform application of cleanser with varying degrees of abrasiveness.

SUMMARY OF THE INVENTION

Generally speaking, in accordance with the invention, an improved foam scrubbing device incorporating a cleanser is provided. A foam scrubbing device constructed and arrranged in accordance with the invention is formed from two layers of foam material which are heat sealed along their respective peripheries with a cleanser material sealed therebetween. The two layers of foam material have different characteristics, such as coarseness, abrasiveness, permeability and flexibility. The two layers are formed in different thicknesses so that each layer will permit uniform amounts of cleanser to pass therethrough. The different degrees of coarseness of each layer permits different types of treatment of skin blemishes and the like. In a preferred embodiment of the invention, the cleanser is a deep cleansing glycerine soap composition. The device may be disposed when the cleanser sealed therein is expended.

Accordingly, it is an object of the invention to provide an improved foam scrubbing device.

Another object of the invention is to provide an improved scrubbing device having at least two surfaces of different coarseness including a cleanser therein.

A further object of the invention is to provide an improved foam scrubbing device having surfaces of different coarseness incorporating a cleanser and providing uniform cleanser on each surface.

Still another object of the invention is to provide an improved foam scrubbing device useful for treatment of skin blemishes at different stages thereof.

Another object of the invention is to provide an improved foam scrubbing device having a deep cleansing glycerine soap disposed between foam layers of different coarseness and permeability.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view showing a foam scrubbing device constructed and arranged in accordance with the invention;

FIG. 2 is a cross-sectional view of the device of FIG. 1 taken along line 2—2;

FIG. 3 is a partial-sectional view of the device of FIG. 1 taken along line 3—3;

FIG. 4 is a perspective view of another foam scrubbing device in accordance with the invention; and FIG. 5 is a perspective view of a further embodiment of the invention;

DESCRIPTION OF THE PREFERRED EMBODIMENTS

Referring now to FIG. 1, a foam scrubbing device constructed and arranged in accordance with the invention is shown generally as 10. Scrubbing device 10 has a substantially diamond shape in plan view or a lemon shape and is formed from a first dense foam layer 11 and a second porous foam layer 12 which are heat-sealed along a seam 13 between dense layer 11 and porous layer 12. Scrubbing device 10 is provided in a diamond shape as this configuration fits neatly into a user's hand and provides end regions 15 and 16 which are convenient for reaching generally hard to clean areas of the face and other portions of the body. In FIGS. 2 and 3, foam scrubbing device 10 is shown in cross-section to illustrate the relative thickness of dense layer 11 and porous layer 12 and a cleansing bar 14 sealed therebetween.

In this exemplary embodiment, dense layer 11 is thinner than porous layer 12, has a pore count of about 50 to 70 pores per lineal inch and may be provided in thicknesses ranging from about $\frac{1}{4}$ to $\frac{1}{2}$ inch thick. Preferably, dense layer 11 has about 60 pores per inch and is about $\frac{3}{8}$ inches thick. Porous layer 12 is thicker than dense layer 11, has a pore count of about 20 to 40 pores per lineal inch and may be provided in thicknesses ranging from about $\frac{1}{2}$ to $\frac{3}{4}$ inches thick. Preferably, porous layer 12 has about 30 pores per lineal inch and is about $\frac{5}{8}$ inches thick. The thicknesses of foam layers 11 and 12 are selected so that substantially equal amounts of cleanser will pass through each foam layer 11 and 12. Actual relative thicknesses are selected depending on the actual porosity of the layers.

Foam scrubbing device 10 of FIGS. 1–3 is approximately 3 inches$\times$5 inches and about 1 inch thick. Cleansing bar 14 is a block of soap of about $1\frac{1}{2}$ inch$\times$1 inch$\times\frac{1}{2}$ inch in thickness and may be of any conventional soap composition. However, it has been found that foam scrubbing device 10 is particularly well-suited for cleansing generally difficult skin conditions when cleansing bar 14 is a deep cleansing soap comprising glycerine which will be described in more detail below. A foam scrubbing device of this size is convenient for cleansing facial skin and it is to be recognized that the size may be increased for body cleansing and massaging.

The foam material utilized for forming foam layers 11 and 12 of foam scrubbing device 10 may be any conventional foam material, but preferably is a polyester foam available with different physical characteristics. These polyester foams find typical applications in weather stripping, insulation, protective packaging, air filtration, cushions and the like. Proper selection of physical properties of the polyester foams makes them particularly well-suited for use in the foam scrubbing devices constructed and arranged in accordance with the invention.

In this exemplary embodiment of the invention, dense foam layer 11 is formed from a flexible polyester-polyurethane foam having about 60 pores per lineal inch. Porous foam layer 12 is also formed from the same flexible polyester-polyurethane foam material having about 30 pores per lineal inch. Nominally, both layers have a density of about 2 pounds per cubic foot. The density of the foam material may vary from about 2 to 4 pounds per cubic foot. In all cases, the selected foam material should be flexible to semi-rigid in order to provide sufficient abrasiveness for effective cleansing. The coarseness of the polyester foam selected will vary depending whether the scrubbing device is to be used for face cleansing and massaging, for the head, body or feet. For example, a rigid foam will be selected for treating dandruff and similar scalp conditions. Of course, the composition of the cleansing soap bar sealed in the scrubbing device will correspondingly vary for each intended use.

Several deep cleansing glycerine soap compositions have been found to be particularly well-suited for use with foam scrubbing device 10. Three of these particular formulations are set forth in the examples in the following Table and are set forth as illustrative of the invention and not intended in a limiting sense. In each case, the percentages given are in weight percents, based on the total weights of the composition.

TABLE

| Ingredients (percent by weight) | Examples 1 | 2 | 3 |
|---|---|---|---|
| Sodium Tallowate | 23 | 23 | 19 |
| Sodium Cocoate | 19 | 17 | 15.7 |
| Sucrose | 19 | 19 | 15.7 |
| Glycerine | 6 | 5 | 5 |
| Sodium Castorate | 3.5 | 3.5 | 2.9 |
| Water | 19.1 | 18.1 | 15.7 |
| Fragrance | 0.4 | 0.4 | .3 |
| EDTA | 10 | 10 | 8.3 |
| Sulfur | | 2 | |
| Salicylic Acid | | 2 | |
| Almond Oil | | | .8 |
| Coconut Butter | | | 8.3 |
| Mineral Oil | | | 8.3 |

The foam scrubbing device including a deep cleansing sub-composition of the type illustrated in Example 1 is particularly well-suited for deep cleansing. The buffing and foaming action of the deep cleansing composition of Example 1 helps remove dirt, whiteheads, blackheads and dead skin cells. In addition, it cleanses oily skin and helps control acne pimples. It gives the skin a fresh, clean, healthy and natural look. It has been found that a foam scrubbing device of this type foams easily, washed freely and lasts about 14 to 21 days with three cleansing applications per day. At this time the devices were disposed in order to maintain cleanliness and eliminate the danger of re-infection or contamination.

A foam scrubbing device including a soap of the composition of the type illustrated in Example 2 is also well-suited for cleansing when an acne condition exists and is effective for drying oily skin. A foam scrubbing device including a cleansing bar of the type illustrated in Example 3, is particularly well-suited for deep cleaning of dry skin.

The particular composition of the cleansing bar may be varied. For example the glycerine content may vary from about 3 to 25 weight percent. The amount of sodium soap resulting from coconut oil, tallow and castor oil as illustrated, or any other fat or oil capable of yielding a sufficiently hard soap bar, may vary from about 35 to 60 weight percent of the cleansing bar. Preferably, the saponified castor accounts for about 1 to 5 weight percent. Similarly, the sugar content, shown as sucrose for example, may vary from about 10 to 30 weight percent. Ethylenediaminetetraacetic acid, illustrated as a chelating agent, is not essential, but preferably is present from about 3 to 15 weight percent.

If the foam scrubbing device is to be used for drying oily skin, an effective amount of suitable drying agents will be added to the composition of Example 1. Similarly, if dry skin is to be treated, additional cosmetic oils, such as almond oil, coconut butter, mineral oil and the like may be added as shown in Example 3. Of course, an effective amount of a fragrance may be added to these various compositions.

Referring now to FIG. 4, a generally round cylindrical shaped foam scrubbing device 18 constructed in accordance with the invention is shown. Foam scrubbing device 18 is formed from a dense foam layer 19 and a porous foam layer 20 sealed along a seam 21 between dense foam layer 19 and porous foam layer 20. A glycerine cleansing bar 22 is sealed between dense foam layer 19 and porous foam layer 20. In FIG. 5, a foam scrubbing device 24 having a substantially rectangular shape is shown generally as 24. Foam scrubbing device 24 is formed from a dense foam layer 25 and a porous foam layer 26 sealed at a seam 27 therebetween. A glycerine cleansing bar 28 is sealed between the foam layers 25 and 26.

Accordingly, by constructing and arranging a foam scrubbing device in accordance with the invention, a scrubbing device for providing deep cleansing action for varying skin conditions is provided. The flexible to semi-rigid foam utilized provides a mild abrasive action to help control acne pimples, whiteheads and blackheads. By including a relatively thick porous foam layer and a relatively thin dense foam layer, substantially equal amounts of cleanser will pass through each layer. In addition, the varying shapes of the devices of the invention, allows deep cleansing and generally inaccessible areas, such as creases around the nose and chin. Most significantly, a foam scrubbing device arranged in accordance with the invention avoids contamination and re-infection as it is designed to be disposable after a relatively short period of use.

It will thus be seen that the objects set forth above among those made apparent from the preceding description, are efficiently attained and, since certain changes may be made in the above construction without departing from the spirit and scope of the invention, it is intended that all matter contained in the above description or shown in the accompany drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A foam scrubbing device comprising:

a glycerine soap bar;

a first dense foam layer of a foam material having a given porosity and thickness for allowing a given amount of wetted soap to pass therethrough;

a second porous foam layer of foam material having substantially the same shape as said first layer, greater porosity and being thinner than said first dense layer for allowing about the same amount of wetted soap to pass therethrough as passes through said first dense layer;

said glycerine soap bar disposed between said first and second layers, said first and second foam layers heat sealed about the peripheral edges thereof for encapsulating said soap bar, whereby the different porosities of the two layers provide different abrasive characteristics for cleansing and scrubbing.

2. The foam scrubbing device of claim 1, wherein said foam material is a polyester-polyurethane foam having a density of about 2 to 4 pounds per cubic foot.

3. The foam scrubbing device of claim 2, wherein said dense foam material has a pore count of about 50 to 70 pores per lineal inch and said porous foam layer has a pore count of about 20 to 40 pores per lineal inch.

4. The foam scrubbing device of claim 3, wherein said device is substantially diamond shape.

5. The foam scrubbing device of claim 3 wherein said dense foam material has a pore count of about 60 pores per lineal inch and said porous foam layer has a pore count of about 30 pores per lineal inch.

6. A foam scrubbing device formed from a polyester-polyurethane foam material having a density of from about 2 to 4 pounds per cubic foot, comprising:

a first dense foam layer having about 50 to 70 pores per lineal inch;

a second porous foam layer having about 20 to 40 pores per lineal inch, each said first dense and second porous foam layer having substantially the same shape, said first porous layer having a thickness greater than said second dense layer;

said first dense and said second porous foam layers heat sealed about their respective peripheries for forming a sealed cavity therebetween;

a deep cleansing glycerine soap bar disposed in said cavity, said glycerine soap bar having from about 3 to 25 percent glycerine, from about 35 to 60 percent sodium soap, from about 1 to 5 percent sodium castorate, from about 10 to 30 percent sugar, from about 3 to 15 percent ethylenediaminetetraacetic acid, and the balance water, all percentages being weight percent, based on the total weight of the composition.

* * * * *

UNITED STATES PATENT AND TRADEMARK OFFICE

CERTIFICATE OF CORRECTION

PATENT NO. : 4,240,760

DATED : December 23, 1980

INVENTOR(S) : Stella R. Levine

It is certified that error appears in the above—identified patent and that said Letters Patent is hereby corrected as shown below:

Claim 1, line 8, delete "thinner" and insert --thicker--.

Signed and Sealed this

*Fourth* Day of *August 1981*

[SEAL]

*Attest:*

GERALD J. MOSSINGHOFF

*Attesting Officer* *Commissioner of Patents and Trademarks*